US008302533B2

(12) United States Patent
Peers-Smith

(10) Patent No.: US 8,302,533 B2
(45) Date of Patent: Nov. 6, 2012

(54) TRIGGER SIGNAL ATTENUATION AND PROTECTION DEVICE

(75) Inventor: Roy Peers-Smith, Ross-on-Wye (GB)

(73) Assignee: Kirintec Limited, Ross-on-Wye (GB)

( * ) Notice: Subject to any disclaimer, the term of this patent is extended or adjusted under 35 U.S.C. 154(b) by 205 days.

(21) Appl. No.: 12/774,867

(22) Filed: May 6, 2010

(65) Prior Publication Data

US 2010/0282050 A1 Nov. 11, 2010

(51) Int. Cl.
*F42D 5/00* (2006.01)

(52) U.S. Cl. ..... 102/303; 86/50; 89/1.13; 102/402; 219/212

(58) Field of Classification Search ..... 86/50; 102/303, 102/402, 403; 89/1.13; 219/212
See application file for complete search history.

(56) References Cited

U.S. PATENT DOCUMENTS

| | | | | |
|---|---|---|---|---|
| 5,243,911 | A * | 9/1993 | Dow et al. | 102/202.2 |
| 5,291,829 | A * | 3/1994 | Avory et al. | 102/202.2 |
| 5,546,862 | A * | 8/1996 | Schabdach | 102/302 |
| 7,373,867 | B2 * | 5/2008 | Ryan | 86/50 |
| 7,746,265 | B2 * | 6/2010 | Brumley et al. | 342/13 |
| 7,810,421 | B2 * | 10/2010 | Hiza et al. | 89/1.13 |
| 7,874,250 | B2 * | 1/2011 | Veneruso | 102/322 |
| 7,980,166 | B1 * | 7/2011 | Fuqua et al. | 89/36.07 |
| 8,010,038 | B2 * | 8/2011 | Valentine et al. | 455/1 |
| 2006/0011054 | A1 | 1/2006 | Walthall, III et al. | |
| 2008/0029502 | A1 * | 2/2008 | You et al. | 219/212 |
| 2008/0254738 | A1 * | 10/2008 | Brumley et al. | 455/1 |
| 2009/0188379 | A1 | 7/2009 | Hiza et al. | |
| 2010/0170383 | A1 * | 7/2010 | Willner | 86/50 |
| 2010/0200558 | A1 * | 8/2010 | Liu et al. | 219/212 |
| 2010/0206863 | A1 * | 8/2010 | Ritter | 219/202 |
| 2010/0259436 | A1 * | 10/2010 | Brumley et al. | 342/14 |
| 2011/0223851 | A1 * | 9/2011 | Stoddard | 455/1 |

FOREIGN PATENT DOCUMENTS

| | | |
|---|---|---|
| DE | 19717474 | 4/1997 |
| GB | 1459743 | 12/1976 |
| WO | 2009024108 | 2/2009 |

OTHER PUBLICATIONS

British Search Report dated Jul. 27, 2010.
British Search Report dated Aug. 12, 2009.

* cited by examiner

*Primary Examiner* — Michael David
(74) *Attorney, Agent, or Firm* — Andrus, Sceales, Starke & Sawall, LLP

(57) ABSTRACT

A protection device comprises a covering including at least a layer of ballistics material, and a layer of an electromagnetic screening material.

14 Claims, 2 Drawing Sheets

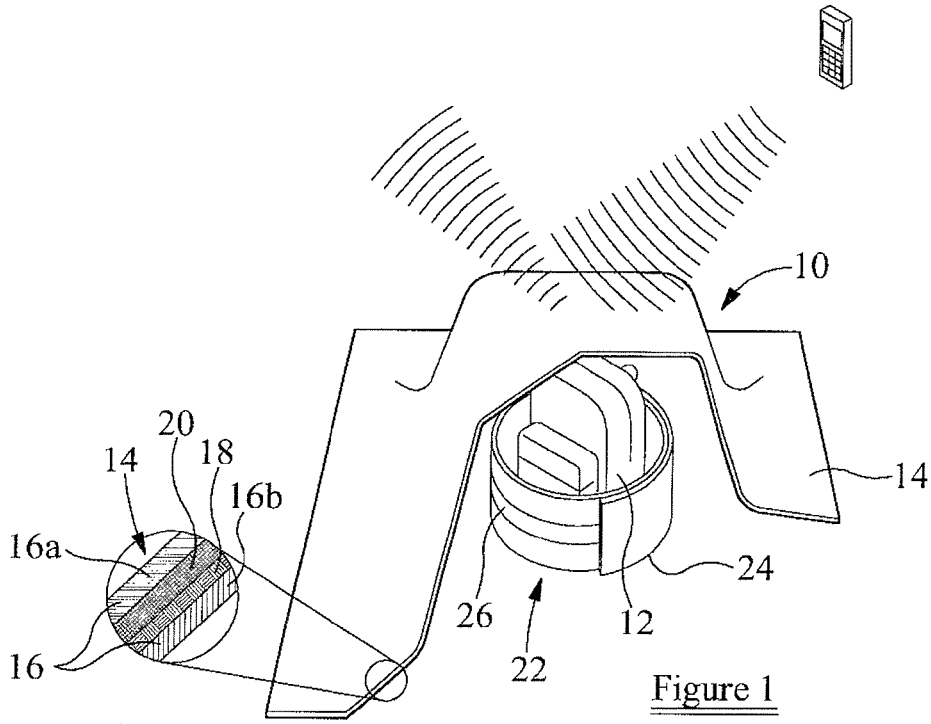
Figure 1
Figure 2
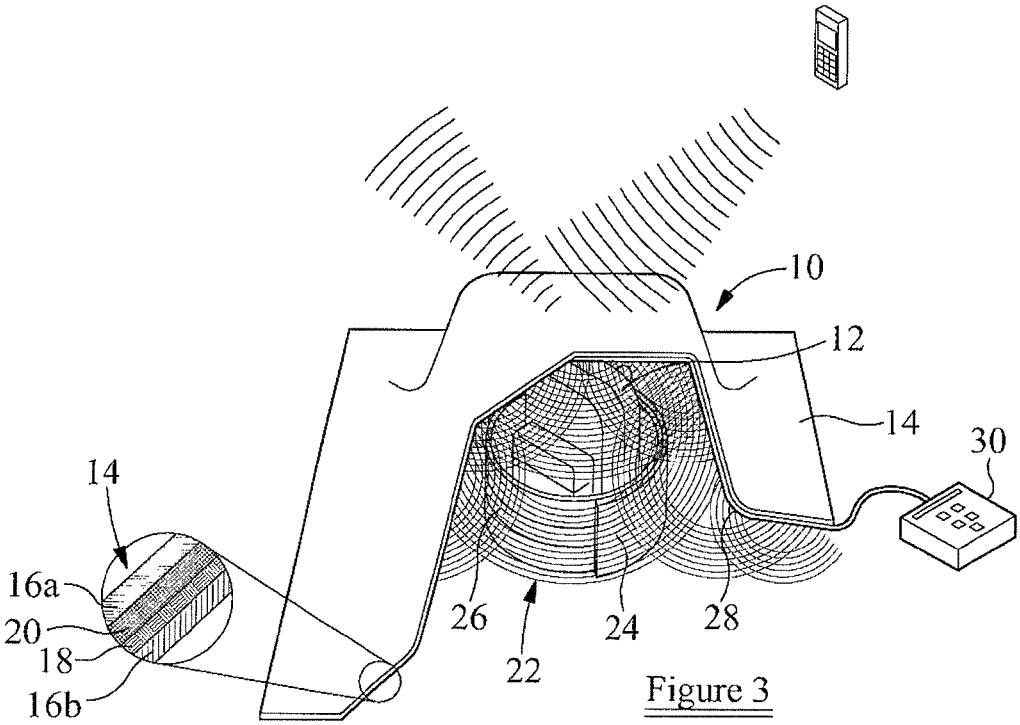
Figure 3
Figure 4

TRIGGER SIGNAL ATTENUATION AND PROTECTION DEVICE

CROSS-REFERENCE TO RELATED APPLICATIONS

This application claims priority of GB Patent Application No. 0907782.7, filed May 7, 2009 and GB Patent Application No. 0922030.2, filed Dec. 17, 2009, both of which are hereby incorporated by reference.

This invention relates to a protection device, and in particular to a protection device intended for use in protecting against injury or damage caused by explosions, for example in the event that a suspect package or object which is thought to contain an explosive device is located.

Where suspicious packages, items of luggage or the like are found, it is known to place a blast suppression device, for example in the form of a blast suppression blanket, over the package or the like to contain fragments in the event that an explosive device within the package or the like detonates. Clearly, containment of such fragments reduces the risk of injury to individuals close to the package or the like, and also reduces the risk of damage in the surrounding area.

A number of blast suppression devices are known. For example, GB 1459743 and U.S. Pat. No. 3,648,613 both describe blast blankets designed for this purpose, the blankets including a number of layers of a suitable ballistics material to resist tearing or rupturing of the blanket and avoid or reduce the passage of fragments through the material. In the event of detonation, fragments resulting from the explosion are thus contained by the blast suppression device. Consequently, the risk of damage or injury is reduced. DE 19717474 describes a blast suppression device intended for use in mailrooms or the like and into which suspect letters or small packages can be placed so as to contain fragments in the event of explosion.

Although such devices may be successful in reducing the risk of injury or damage in the event of an explosion, it would be preferable to prevent detonation and thereby further reduce the risk of injury or damage. It is an object of the invention to provide a protection device whereby the risk of detonation is reduced.

According to one aspect of the invention there is provided a protection device comprising a covering incorporating an electromagnetic screening layer, an antenna, and an inhibitor device operable to cause the antenna to transmit an inhibiting signal into a volume enclosed, at least in part, by the covering, in use.

The covering may include a layer of ballistics material.

In use, if the protection device is positioned over an explosive device which is intended to be detonated remotely by an RF device, the electromagnetic screening material will prevent or reduce the risk of the detonation command signal being received by the explosive device, and so reduce the likelihood of detonation. The risk of injury or damage is thus reduced. If, despite the presence of the electromagnetic screening material, the explosive device detonates, for example as a result of imperfect screening or as a result of detonation being triggered other than by receipt of the RF signal, then the ballistics material will serve to contain most or all of the fragments resulting from the explosion, again reducing the risk of injury and/or damage.

The protection device is conveniently in the form of a blast suppression blanket arranged to be positioned over a potential explosive device. However, this need not always be the case, and other arrangements are possible. For example, the protection device may further comprise a support frame or the like for the covering so that the protection device forms, in use, a tent-like structure. The support frame may be secured to the covering, or may be arranged to have the covering positioned thereon.

Preferably, the protection device further comprises a containment device that can be positioned around a potential explosive device and that serves, in use, to direct blast, in the event of detonation, towards the covering.

Preferably, the inhibitor device includes a delay means operable to delay the commencement of the transmission of the jamming signal for a predetermined period of time after activation of the inhibitor device.

It will be appreciated that such an arrangement further reduces the risk of injury and damage by further reducing the risk of detonation.

Although the antenna may conveniently be incorporated into the covering, thereby simplifying use of the protection device, the antenna could be a separate component. Likewise, although the screening material layer is conveniently incorporated into the covering, this need not always be the case.

Preferably, an end of the antenna remote from its connection to the inhibitor device is coupled to the covering. Such an arrangement is advantageous as by detecting the presence of the coupling of the antenna to the screening layer, it can be ensured that the inhibiting signal is only transmitted when the antenna is properly fitted to the covering. Further, the device is able to determine whether or not the antenna is functioning correctly.

Preferably, the antenna is designed to be able to transmit signals over a wide range of frequencies whilst avoiding the resonances typically associated with such transmissions. For example, the antenna may conveniently be of a leaky coaxial form.

The invention further relates to an electromagnetic screening layer, and to an antenna and associated inhibitor device, adapted for use in the aforementioned protection device.

The invention will further be described, by way of example, with reference to the accompanying drawings, in which:

FIG. 1 is a diagrammatic representation of a protection device in accordance with one embodiment of the invention;

FIG. 2 is a diagrammatic sectional view of part of the protection device of FIG. 1;

FIGS. 3 and 4 are views similar to FIGS. 1 and 2 illustrating an alternative embodiment.

Figure 5:
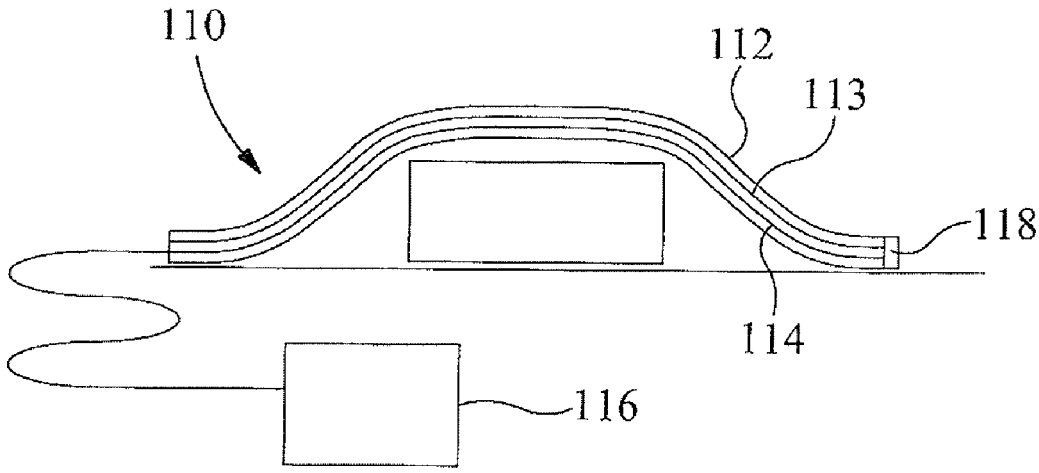
FIG. 5 illustrates another embodiment.

Referring firstly to FIGS. 1 and 2, a protection device 10 according to one embodiment of the invention is illustrated for use in the event that a suspicious package, item of luggage or other object (hereinafter referred to as an item 12) is found. The protection device 10 comprises a covering 14 in the form of a blast suppression blanket. The covering 14 is of multi-layered form, as best shown in FIG. 2, and comprises an outer skin 16 enclosing a multi-layered ballistics material component 18 and a layer 20 of an electromagnetic screening material. The outer skin 16 is preferably of two-coloured form, the upper surface 16*a* of the outer skin 16 being differently coloured to the lower surface 16*b*. For example the upper surface 16*a* may be colored blue and provided with warning markings indicating the covering 10 is laid over a potentially dangerous item 12. The lower surface 16*b* is preferably brightly coloured, for example of bright yellow colour. With such an arrangement, if the brightly coloured lower surface 16*b* is visible when positioned over the item 12 then this will provide an indication to a user that the potentially dangerous item 12 is not properly covered.

The protection device 10 of this embodiment further comprises a blast containment ring 22 intended to be positioned around the item 12 prior to placing the covering 14 over the item 12. The blast containment ring 22 comprises an elongate strip 24 of a ballistics material which, in use, is bent or curved to form a loop, and fastener means 26, for example in the form of a Velcro strap, to hold the strip 24 in this configuration.

In use, where a suspicious item 12 is found, the containment ring 22 is assembled, in situ, around the item 12. Although positioned around the item 12, the containment ring 22 is positioned so as to avoid touching or otherwise disturbing the item 12, if possible, in order to minimise the risk of detonation. The covering 14 is then positioned over the item 12, the covering 14 draping around the containment ring 22 and resting upon the ground or floor surface upon which the item 12 is positioned. When correctly positioned none of the, preferably brightly coloured, underside surface 16*b* of the covering 14 should be visible.

An arrangement of this type is advantageous in that, in the event that the item 12 contains an RF signal detonated explosive device, the likelihood of detonation occurring is reduced as the electromagnetic screening material layer 20 will attenuate the transmission of RF signals including the detonation signal to the item 12. The degree to which the signal will be attenuated will depend upon a number of factors. For example, the type of material used in the layer 20 will affect the level of attenuation. It is envisaged that the material used will achieve signal strength attenuation in the range of −20 dB to −40 dB, but it will be appreciated that the invention is not restricted to this range. Further, environmental factors such as the material of the ground or floor surface upon which the item 12 is positioned will significantly affect the attenuation of the signal, although this may be mitigated to some extent by ensuring that the covering 14 is sufficiently large that it extends over and in contact with the ground or floor surface over a significant area surrounding the item 12.

Clearly, if detonation is prevented, the risk of injury or damage is reduced.

When used in a situation in which the item 12 is detonated other than by means of the transmission of an RF signal, for example if detonated using a timer device, or where the screening material layer 20 is unable to attenuate the detonation signal to an extent sufficient to avoid detonation, then the risk of injury or damage is still reduced even if detonation occurs as the containment ring 22 will operate to direct the explosive blast towards the centre of the covering 14, and the ballistics material component 18 thereof will serve to prevent or reduce the high speed scattering of fragments resulting from the explosion. Such containment of the fragments reduces the risk of injury or damage resulting from impact by flying fragments.

The covering 14 and containment ring 22 are preferably of materials substantially transparent to X-rays so as not to prevent or impede the use of X-ray based diagnostics equipment. Preferably the covering 14 is provided with handles or loops to allow easy handling either by personnel or by other devices. It is conveniently of a rot-proof, frost resistant, anti-static, fire retardant material.

Although sufficient to prevent detonation of many RF signal detonated devices, according to a second embodiment of the invention as shown in FIGS. 3 and 4 the covering 14 further includes an antenna 28, located between the electromagnetic screening layer 20 and the underside of the outer covering or skin 16, connected to an RF inhibitor or signal jamming device 30. Conveniently the covering 14 is provided with connector means (not shown) whereby an output lead from the inhibitor device 30 can be connected to the antenna 28, but permanently connected arrangements may also be possible. In use, the protection device 10 of this embodiment of the invention is positioned over and around a suspicious item 12 in much the same manner as that of the first embodiment. Once so positioned, the inhibitor device 30 is activated. Activation of the inhibitor device 30 first triggers operation of a delay timer device. After a predetermined period of time, say, one minute, the inhibitor device 30 commences the output of a jamming signal which is transmitted by the antenna 28 into the volume contained, in part, by the covering 14. The delay resulting from the operation of the timer device is advantageous in that it allows a user to move to a safe location before the transmission of the jamming signal commences so that, if the commencement of the transmission of the jamming signal itself causes detonation, the risk of injury is reduced. The transmission of the jamming signal into the volume contained by the covering 14 reduces the risk of reception of a detonation signal by the item 12, and thus further reduces the risk of detonation. The benefits arising from the transmission of the jamming signal are in addition to those arising from the presence of the screening layer 20 and the blast suppression offered by the covering 14 outlined hereinbefore.

It will be appreciated that the volume contained by the covering 14 is relatively small, and the antenna 28 is positioned relatively close to the item 12. Consequently, the jamming signal need only be a relatively low power signal and the inhibitor device 30 can thus readily be powered by a battery or other portable power supply, if desired. The electromagnetic screening layer 20 will serve, in addition to attenuating the transmission of signals to the item 12, to substantially contain the jamming signal, thus other communications devices used in the vicinity of the protection device 10 will continue to operate normally without significant additional interference.

The precise nature of the inhibitor device 30 is not of particular relevance to the invention in that the manner in which the signals are produced and the frequencies or frequency ranges covered may take a variety of known forms that will be understood by a skilled technician, and so it will not be described in further detail herein.

Although in the arrangement described hereinbefore the antenna 28 is incorporated into the covering 14, this need not always be the case and arrangements are possible in which they are separate components. Similarly, although the layer 20 of electromagnetic screening material is described as being incorporated into the covering 14 with the ballistics material component 18, this need not always be the case and arrangements may be possible within the scope of the invention in which the layer 20 comprises a separate element. Further, although a containment ring 22 is described, this may not always be present. Although the protection device 10 is described as a blast suppression blanket, a number of other arrangements are possible, for example it may form the wall of a tent-like enclosure supported by an associated frame. Depending upon how the protection device 10 is used, it may also be possible to fully enclose a suspicious package, rather than leave it resting upon the ground or floor surface or the like, and thereby further enhance the electromagnetic screening of the device.

Where used with relatively large items 12, then several devices 10 may be used in conjunction with one another to cover the item 12 and provide RF screening, signal jamming thereto. Alternatively, the device may be of increased dimensions to allow it to be positioned over a large item, for example such as a vehicle.

It will be appreciated that the invention has a number of benefits over known arrangements. As described hereinbefore, the risk of RF signal-based detonation is reduced. The device is simple and convenient to use. It is of relatively small dimensions, when not in use, and so storage and handling are simplified. As mentioned hereinbefore, it is preferably rot-proof and water proof, so performance deterioration over time should not be an issue. It is suitable for use by a first responder to reduce the risk of injury or damage until such time as the item can be rendered safe by a specialist disposal expert, and permits continued limited occupation of the vicinity in which the item is located, for example to allow searches for other items to be undertaken in a relatively safe manner.

Referring next to FIG. 5 there is illustrated another embodiment of protection device in accordance with the invention comprising a covering 112. The covering 112 includes a layer 113 of an electromagnetic screening material and an antenna 114. Optionally, the covering 112 may also include a layer of a ballistics material suitable to contain fragments in the event of detonation of an explosive device over which the protection device 110 is positioned. An inhibitor device 116 is connected to the antenna 114 to permit the transmission of signals into the volume contained or defined, at least in part, within the covering 112 to interfere with the reception of a control or detonation signal by the explosive device. It will be appreciated that such an arrangement is substantially as described hereinbefore.

In accordance with this embodiment of the invention, the antenna 114 is of a form permitting the transmission of signals over a wide range of frequencies whilst avoiding the resonance problems that are generally associated therewith. For example, the antenna 114 may be of a leaky coaxial form. By enabling transmission of the inhibiting signal over a range of frequencies, in a simple and convenient manner, the risk of detonation is further reduced.

An end part of the antenna 114 remote from the inhibitor device 116 is connected, in use, to a matched impedance 118 physically mounted upon the covering 112. The inhibitor device 16 is controlled in such a manner as to be able to transmit an inhibiting signal only when it is sensed that the antenna 114 is connected to the impedance 118. Consequently, the use of the inhibitor device 116 and antenna 114 to transmit an inhibiting signal in the absence of the screening layer 113 is prevented, or at least requires significant modification. Further, in the event that the antenna 114 is damaged, the inhibitor device 116 may no longer be able to sense the presence of impedance 118 and so will not transmit the inhibiting signal. In either case, the inhibitor device 116 is preferably arranged to output an appropriate warning to the user to indicate the status of the device.

Conveniently, the antenna 114 is connected, in use, to the impedance 118 using a suitable releasable connector, thereby allowing replacement of the antenna 114, if required.

A number of other modifications and alterations are possible without departing from the scope of the invention.

The invention claimed is:

1. A protection device comprising a covering incorporating an electromagnetic screening layer, an antenna, and an inhibitor device operable to cause the antenna to transmit an inhibiting signal into a volume enclosed, at least in part, by the covering, in use, wherein the electromagnetic screening layer attenuates the transmission of signals into the said volume from the exterior thereof, and attenuates the transmission of the inhibiting signal out of the said volume.

2. A device according to claim 1, wherein the covering includes a layer of ballistics material.

3. A device according to claim 1, wherein the covering comprises a blast suppression blanket.

4. A device according to claim 1, further comprising a support frame or the like for the covering so that the protection device forms, in use, a tent-like structure.

5. A device according to claim 1, further comprising a containment device that can be positioned around a potential explosive device and that serves, in use, to direct blast, in the event of detonation, towards the covering.

6. A device according to claim 1, wherein the inhibitor device comprises an RF inhibitor device operable to transmit a jamming signal into the volume enclosed, in part, by the covering, in use.

7. A device according to claim 1, wherein the antenna is incorporated into the covering.

8. A device according to claim 1, wherein the inhibitor device includes a delay means operable to delay the commencement of the transmission of the jamming signal for a predetermined period of time after activation of the inhibitor device.

9. A device according to claim 1, wherein an end of the antenna remote from its connection to the inhibitor device is coupled to the covering.

10. A device according to claim 9, further comprising means for detecting the presence of the coupling of the antenna to the screening layer.

11. A device according to claim 1, wherein the antenna is designed to be able to transmit signals over a wide range of frequencies whilst avoiding the resonances typically associated with such transmissions.

12. A device according to claim 11, wherein the antenna is of a leaky coaxial form.

13. An antenna and an RF inhibitor device adapted for use in a protection device according to claim 1.

14. A layer of an electromagnetic screening material adapted for use in a protection device according to claim 1.

* * * * *